United States Patent [19]

Gründler

[11] Patent Number: 4,938,391

[45] Date of Patent: Jul. 3, 1990

[54] CONVERTIBLE METERING APPARATUS FOR DIFFERENT FLOWABLE GOODS OF UNLIKE CONSISTENCY

[75] Inventor: Bruno Gründler, Neuhausen am Rheinfall, Switzerland

[73] Assignee: SIG Schweizerische Industrie-Gesellschaft, Neuhausen am Rheinfall, Switzerland

[21] Appl. No.: 282,031

[22] Filed: Dec. 9, 1988

[30] Foreign Application Priority Data

Dec. 11, 1987 [CH] Switzerland ..... 4852/87

[51] Int. Cl.[5] ..... B67D 5/06

[52] U.S. Cl. ..... 222/278; 222/288; 222/370; 222/413; 222/556; 141/84; 198/615

[58] Field of Search ..... 222/370, 240, 413, 556, 222/278, 252, 288; 198/615, 661, 666; 141/84

[56] References Cited

U.S. PATENT DOCUMENTS

| | | | |
|---|---|---|---|
| 804,022 | 11/1905 | May | 198/661 X |
| 1,077,810 | 11/1913 | Craggs | 222/413 |
| 2,018,784 | 10/1935 | Hall | 222/413 |
| 2,044,489 | 6/1936 | Karlsson-Ygger | 222/370 X |
| 3,730,332 | 5/1973 | Benzon et al. | 198/666 |
| 4,153,184 | 5/1979 | Parish et al. | 222/288 X |
| 4,158,374 | 6/1979 | Ciuffetti | 222/288 X |
| 4,569,463 | 2/1986 | Pellegrino | 222/288 X |
| 4,662,409 | 5/1987 | Egli . | |
| 4,842,126 | 6/1989 | McConnell | 198/666 |

FOREIGN PATENT DOCUMENTS

| | | | |
|---|---|---|---|
| 987345 | 4/1951 | France | 222/370 |
| 627985 | 2/1982 | Switzerland . | |

*Primary Examiner*—Joseph J. Rolla
*Assistant Examiner*—Gregory L. Huson
*Attorney, Agent, or Firm*—Spencer & Frank

[57] ABSTRACT

A convertible metering apparatus for dispensing metered quantities of different flowable goods of unlike physical properties comprises a housing defining a material storge chamber therein; a motor; and a drive shaft being rotatably connected to the motor and extending into the housing. There is further provided a metering member adapted to handle a flowable material of a first physical property; a discharge unit configured to receive the metering member therein; and a first releasable connecting arrangement for readily connecting the metering member to and readily disconnecting it from the drive shaft. This arrangement ensures that the metering member is readily replaceable by another metering member adapted to handle a flowable material of a second physical property. The apparatus further has a second releasable connecting arrangement for readily connecting the discharge unit to and readily disconnecting it from the housing, whereby the discharge unit is readily replaceble by another discharge unit configured to receive the other metering member therein.

9 Claims, 3 Drawing Sheets

CONVERTIBLE METERING APPARATUS FOR DIFFERENT FLOWABLE GOODS OF UNLIKE CONSISTENCY

BACKGROUND OF THE INVENTION

This invention relates to a fine metering apparatus for the final filling of containers with flowable goods, particularly coffee and is of the type which has a housing defining a material storage chamber, a discharge unit connected to the housing and a rotatable metering member which is accommodated in the discharge unit and which is coupled to a motor by a drive shaft.

U.S. Pat. No. 4,662,409 discloses a fine dosing apparatus, particularly for crystallized sugar. The apparatus includes a housing with a storage for the sugar and a tubular discharge unit connected to the housing. The discharge unit accommodates a conveyor screw which is oriented horizontally and is rotatable about its longitudinal axis. The conveyor screw is connected with a motor by means of a drive shaft. At the outlet end of the tubular discharge unit there is arranged a pre-dosing chamber having a rotary slide.

Swiss Pat. No. 627,985 shows another fine metering apparatus for crystallized sugar which has a compartmentalized wheel rotatable about a horizontal axis and serving as a metering member. The compartments of the wheel are formed by axial grooves provided in the wheel periphery.

In packaging coffee frequently the same packing machine is used for packing ground coffee or packing coffee beans. In such packing machines, according to conventional arrangements, a compromise had to be found for the supplemental fine dosing apparatus which introduces the last, accurately metered portion of material to obtain the desired overall weight for the package. Because ground coffee and unground coffee beans behave differently, the known dosing devices were not optimal for the packaging of either form of coffee.

SUMMARY OF THE INVENTION

It is an object of the invention to provide a fine metering apparatus for the final filling of containers which is capable of optimally handling two types of flowable materials having different physical properties.

This object and others to become apparent as the specification progresses, are accomplished by the invention, according to which, briefly stated, the metering member is releasably connected with the drive shaft of the metering apparatus and its discharge unit is releasably connected with the housing to provide for a replacement of the metering member and the discharge unit for a second metering member and a second discharge unit of different shape to thus permit a selective metering of two types of flowable materials having unlike physical properties.

DESCRIPTION OF THE PREFERRED EMBODIMENT

Figure 2:
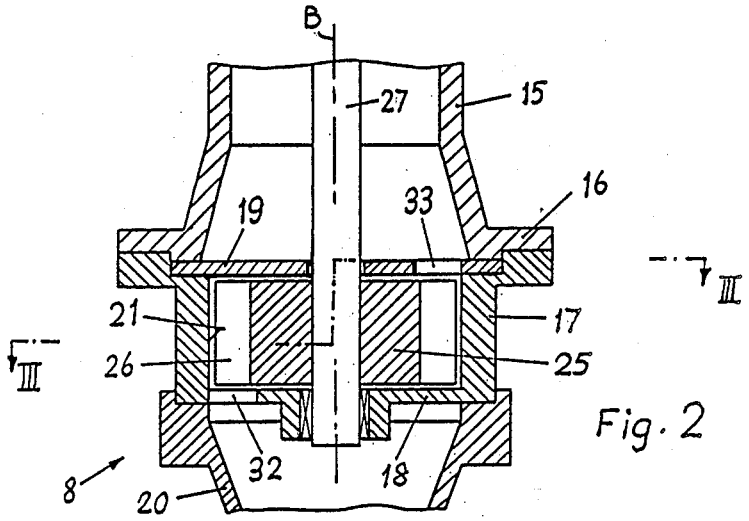
FIG. 2 is an enlarged axial sectional elevational view of a detail of FIG. 1.
Figure 3:
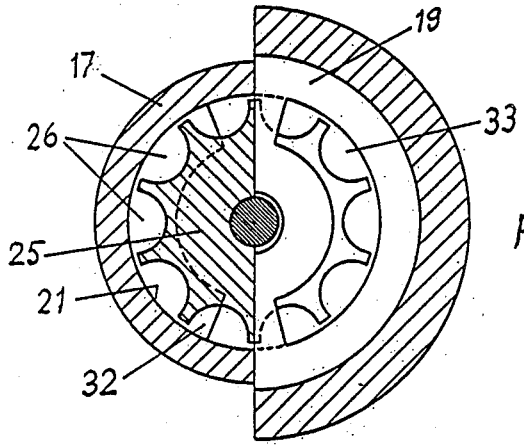
FIG. 3 is a sectional view taken along line III—III of FIG. 2.
Figure 4:
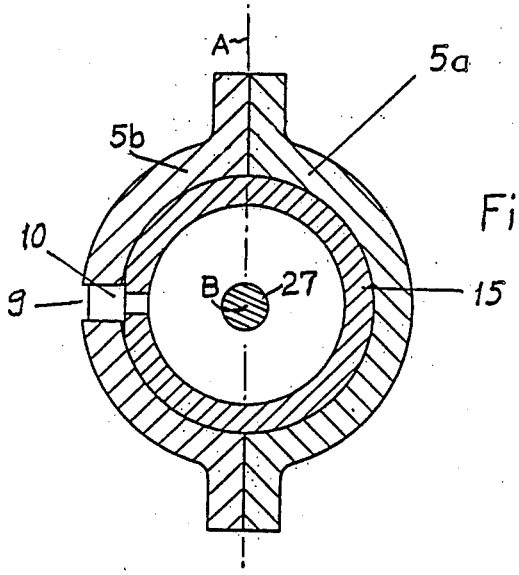
FIG. 4 is a sectional view taken along line IV—IV of FIG. 1.

The metering apparatus illustrated in FIGS. 1–4 has a housing 1 defining a storage chamber 2 for flowable material, such as coffee beans. To the top of the housing 1 there is secured a drive motor 3 which rotates a vertically downwardly extending drive shaft 4. At the lower end the housing 1 carries a downwardly tapering outlet cone (outlet funnel) 5 which, as it may be well observed in FIG. 4, is divided into two parts 5*a*, 5*b* along a plane A containing the axis B of the drive shaft 4. The cone parts 5*a*, 5*b* are secured to one another by non-illustrated screws and have a circumferential groove 6 at their lower end.

With particular reference to FIG. 2, a discharge unit generally designated at 8 is arranged immediately below the outlet cone 5, coaxially with the drive shaft 4. The discharge unit 8 has a radially outwardly projecting annular rib 7 received in the groove 6 of the outlet cone 5. The discharge unit 8 is a three-part component and has a radially outwardly projecting pin 10 which engages into a groove 9 provided at the lower edge of the cone 5 to prevent the discharge unit 8 from rotating relative to the outlet cone 5. An upper tubular portion 15 of the discharge unit 8 includes the annular rib 7 and is, at its lower part, connected with a dish-shaped mid portion 17 by means of a flange 16 forming part of the tubular portion 15. A disc 19 is inserted between the parts 15 and 17. The discharge unit 8 has a third portion 20 which is a downwardly tapering, funnel-shaped discharge spout coupled to the mid portion 17. Between the base disc 18 of the dish-shaped mid portion 17 and the disc 19 there is inserted, with a slight play to the cylindrical inner wall 21 of the mid portion 17, a compartmentalized wheel 25 in which the compartments (chambers) 26 are formed by axial grooves provided in the wheel periphery. The compartmentalized wheel 25 is torque-transmittingly secured to a shaft portion 27 supported in the base disc 18 of the dish-shaped mid portion 17. The shaft portion 27 is torque-transmittingly connected to the drive shaft 4 by means of a push-in shaft coupler 28. The base disc 18 and the disc 19 each have a respective passage 32 and 33 in the zone of the chambers 26. As seen in FIG. 3, the passages 32 and 33 extend through less than one-half of the circumference of the compartmentalized wheel 25 and are offset with respect to one another in the circumferential direction such that the coffee beans which enter into the chambers 26 from above through the passage 33 can exit through the passage 32 only upon rotation of the drive shaft 4. The bottom outlet of the spout 20 is closed off by the shutoff slide 38.

Figure 1:
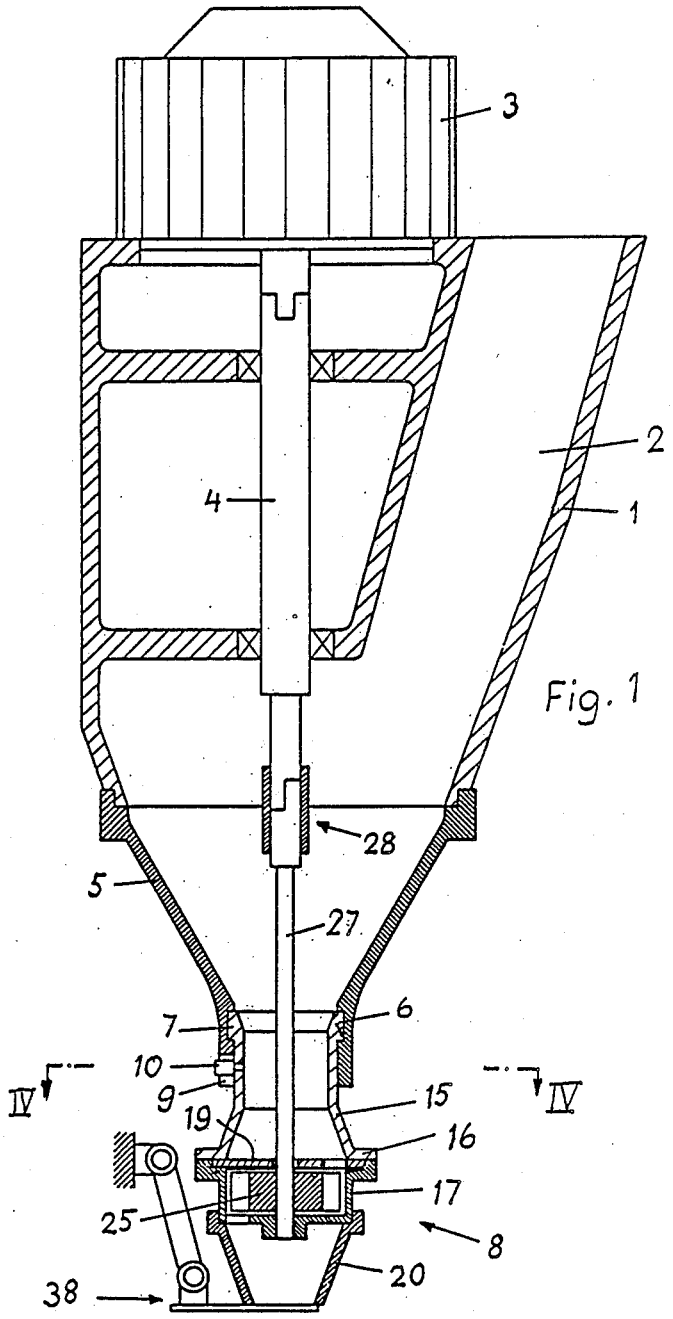
FIG. 1 is an axial sectional elevational view of the preferred embodiment of the invention utilizing a first type of metering member.
Figure 5:
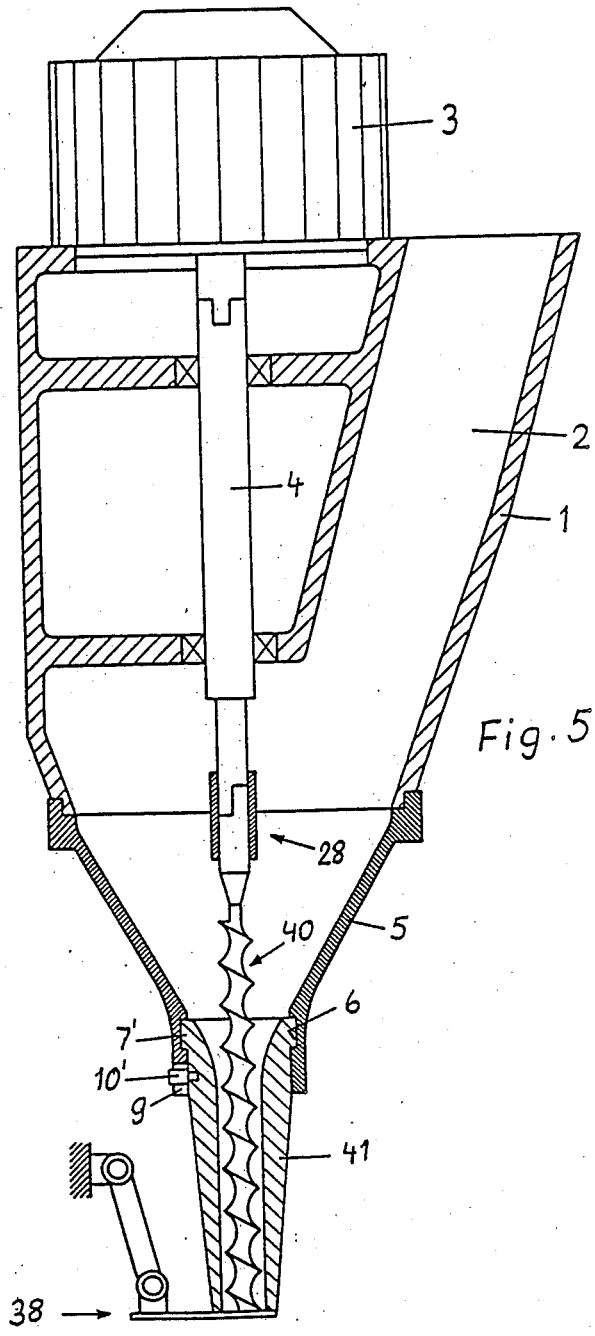
FIG. 5 is an axial sectional elevational view of the preferred embodiment utilizing a second type of the metering member.

In case the supplemental fine metering apparatus is to meter ground coffee rather than coffee beans, the compartmentalized metering member 25 shown in FIGS. 1–4 is not an optimally suited component. For the purpose of converting the apparatus to optimally handle the metering of ground coffee, one half 5*a* or 5*b* of the outlet cone 5 is removed whereupon the discharge unit 8 may be pulled out and, upon this occurrence, the shaft part 27 is pulled out of the push-in shaft coupler 28. As a replacement, as illustrated in FIG. 5, a conveyor screw 40 is inserted into the push-in shaft coupler 28. The discharge unit 41 which corresponds in function to the discharge unit 8 of FIG. 1, is tubular and is provided with an annular rib 7' of a configuration identical to that of annular rib 7 provided on the part 15 of the discharge unit 8. The annular rib 7' is received by the inner annular groove 6 of the outlet cone 5. The discharge unit 41 has an outwardly projecting pin 10' extending into the groove 9 of the outlet cone 5 to prevent a relative rotation between the outlet part 41 and the outlet cone 5. The outlet part 41 surrounds the conveyor screw 40 which, at its outlet end, is controlled by the shutoff gate 38 as was the case in the coffee bean metering arrangement of FIG. 1.

By virtue of the invention there may thus be provided a fine metering apparatus which is readily convertible by a rapid replacement of only a few individual components to optimally handle physically different flowable materials by the choice of an optimal metering member.

The present disclosure relates to subject matter contained in Swiss Patent Application No. 4852/87-4 (filed Dec. 11, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. A metering apparatus kit for providing a convertible metering apparatus to dispense metered quantities of different flowable goods of unlike physical properties, comprising (a) a housing defining a material storage chamber therein;

(b) a motor;

(c) a drive shaft having an axis and being rotatably connected to said motor and extending into said housing;

(d) a first metering member adapted to handle a flowable material of a first physical property;

(e) a second metering member adapted to handle a flowable material of a second physical property;

(f) a first discharge unit configured to receive said first metering member therein;

(g) second discharge unit configured to receive said second metering member therein;

(h) a first releasable connecting means for readily connecting a selected one of said first and second metering members to and readily disconnecting it from said drive shaft; and (i) a second releasable connecting means for readily connecting a selected one of said first and second discharge units to and readily disconnecting it from said housing.

2. A metering apparatus kit as defined in claim 1, wherein said drive shaft is vertically oriented.

3. A metering apparatus kit as defined in claim 1, wherein each said discharge unit has a discharge opening through which metered flowable material leaves the apparatus; further comprising an openable and closable shutoff gate cooperating with the discharge opening of the discharge unit connected to said housing.

4. A metering apparatus kit as defined in claim 1, wherein said second metering member comprises a conveyor screw.

5. A metering apparatus kit as defined in claim 1, wherein said first releasable connecting means comprises a push-in coupling for torque-transmittingly connecting said selected metering member to said drive shaft.

6. A metering apparatus kit as defined in claim 1, wherein said first metering member comprises a compartmentalized wheel.

7. A metering apparatus kit as defined in claim 6, wherein said first discharge unit comprises first and second axially spaced discs together bounding a space defined within said first discharge unit and accommodating said compartmentalized wheel when said compartmentalized wheel is coupled to said drive shaft and said first discharge unit is coupled to said housing; said first and said second disc each having a throughgoing aperture; the aperture in said first disc being circumferentially offset relative to the aperture in said second disc.

8. A metering apparatus kit as defined in claim 1, further comprising an outlet funnel secured to said housing; said outlet funnel being composed of two separable halves having a parting plane containing said axis of said drive shaft.

9. A metering apparatus kit as defined in claim 8, wherein said second releasable connecting means comprises means defining an annular groove in said outlet funnel and a radially outwardly extending projection formed on said first and second discharge units; said projection being arranged to be received in said annular groove.

* * * * *